US008864506B2

(12) United States Patent
Little et al.

(10) Patent No.: US 8,864,506 B2
(45) Date of Patent: Oct. 21, 2014

(54) CABLE CONNECTOR WITH IMPROVED GROUNDING PLATE

(71) Applicants: Terrance F. Little, Fullerton, CA (US); An-Jen Yang, Irvine, CA (US); Stephen Sedio, Valley Center, CA (US); Richard Lee Malehorn, II, York, PA (US); Chien-Ping Kao, Hershey, PA (US); Kuo-Chun Hsu, New Taipei (TW); Wei-Hung Hsu, New Taipei (TW); Qing-Man Zhu, Kunshan (CN); Jian-Jun Zhu, Kunshan (CN); Li-Shing Hou, New Taipei (TW)

(72) Inventors: Terrance F. Little, Fullerton, CA (US); An-Jen Yang, Irvine, CA (US); Stephen Sedio, Valley Center, CA (US); Richard Lee Malehorn, II, York, PA (US); Chien-Ping Kao, Hershey, PA (US); Kuo-Chun Hsu, New Taipei (TW); Wei-Hung Hsu, New Taipei (TW); Qing-Man Zhu, Kunshan (CN); Jian-Jun Zhu, Kunshan (CN); Li-Shing Hou, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 17 days.

(21) Appl. No.: 13/783,403

(22) Filed: Mar. 4, 2013

(65) Prior Publication Data

US 2014/0248785 A1 Sep. 4, 2014

(51) Int. Cl.
*H01R 13/648* (2006.01)
*H01R 13/658* (2011.01)

(52) U.S. Cl.
CPC ..... *H01R 13/658* (2013.01)
USPC ..... 439/108

(58) Field of Classification Search
CPC ..... H01R 13/65802; H01R 23/688
USPC ..... 439/108, 29, 80, 79, 95, 569, 660
See application file for complete search history.

(56) References Cited

U.S. PATENT DOCUMENTS

| | | | | |
|---|---|---|---|---|
| 7,179,127 | B2 | 2/2007 | Shiu | |
| 7,559,802 | B2 * | 7/2009 | Hu et al. | 439/607.41 |
| 8,070,529 | B2 * | 12/2011 | Xiong et al. | 439/676 |
| 8,262,411 | B2 | 9/2012 | Kondo | |
| 8,684,769 | B2 * | 4/2014 | Kao et al. | 439/607.28 |
| 2010/0210124 | A1 * | 8/2010 | Li | 439/108 |
| 2010/0267261 | A1 * | 10/2010 | Lin et al. | 439/218 |

FOREIGN PATENT DOCUMENTS

| | | |
|---|---|---|
| JP | 4234714 | 12/2008 |
| TW | M399464 | 3/2011 |

* cited by examiner

*Primary Examiner* — Tulsidas Patel
*Assistant Examiner* — Phuongchi T Nguyen
(74) *Attorney, Agent, or Firm* — Wei Te Chung; Ming Chieh Chang

(57) ABSTRACT

A cable connector includes an insulative housing including two sidewalls and a mating slot defined between the two sidewalls, and a plurality of terminals received in the insulative housing. The terminals include contacting portions exposed to the mating slot and connecting portions behind a rear end of the insulating housing. The two sidewalls are loaded with a first row and a second row of the plurality of terminals respectively. The first row includes signal terminals and grounding terminals. A grounding plate is inserted in the insulating housing and between two rows of terminals. The grounding plate defines resilient arms and connecting legs, the resilient arms slant to the first row and touch with the grounding terminals.

8 Claims, 6 Drawing Sheets

CABLE CONNECTOR WITH IMPROVED GROUNDING PLATE

BACKGROUND OF THE INVENTION

1. Field of the Invention

The present invention generally relates to a new I/O connection, and more particularly to a cable connector transmitting high speed signal.

2. Description of Related Art

Recently, personal computers (PC) are used of a variety of techniques for providing input and output. For example, Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As a trend of high speeding rates and miniaturization, from an electrical standpoint, the higher data transfer rates of non-USB protocols are highly desirable for certain applications.

Hence, it is desirable to have an improved structure of an electrical connector.

BRIEF SUMMARY OF THE INVENTION

Accordingly, the object of the present invention is to provide a cable connector with an improved grounding plate.

In order to achieve the above-mentioned object, a cable connector comprises an insulative housing comprising two sidewalls and a mating slot defined between said two sidewalls, and a plurality of terminals received in the insulative housing. The terminals comprise contacting portions exposed to the mating slot and connecting portions behind a rear end of the insulating housing. The two sidewalls are loaded with a first row and a second row of said plurality of terminals respectively, the first row comprises signal terminals and grounding terminals. A grounding plate is inserted in the insulating housing and between said two rows of the plurality of terminals. The grounding plate defines resilient arms and connecting legs, the resilient arms slant to the first row of the plurality of terminals and touch with the grounding terminals.

Other objects, advantages and novel features of the invention will become more apparent from the following detailed description of the present embodiment when taken in conjunction with the accompanying drawings.

DETAILED DESCRIPTION OF THE INVENTION

Figure 1:
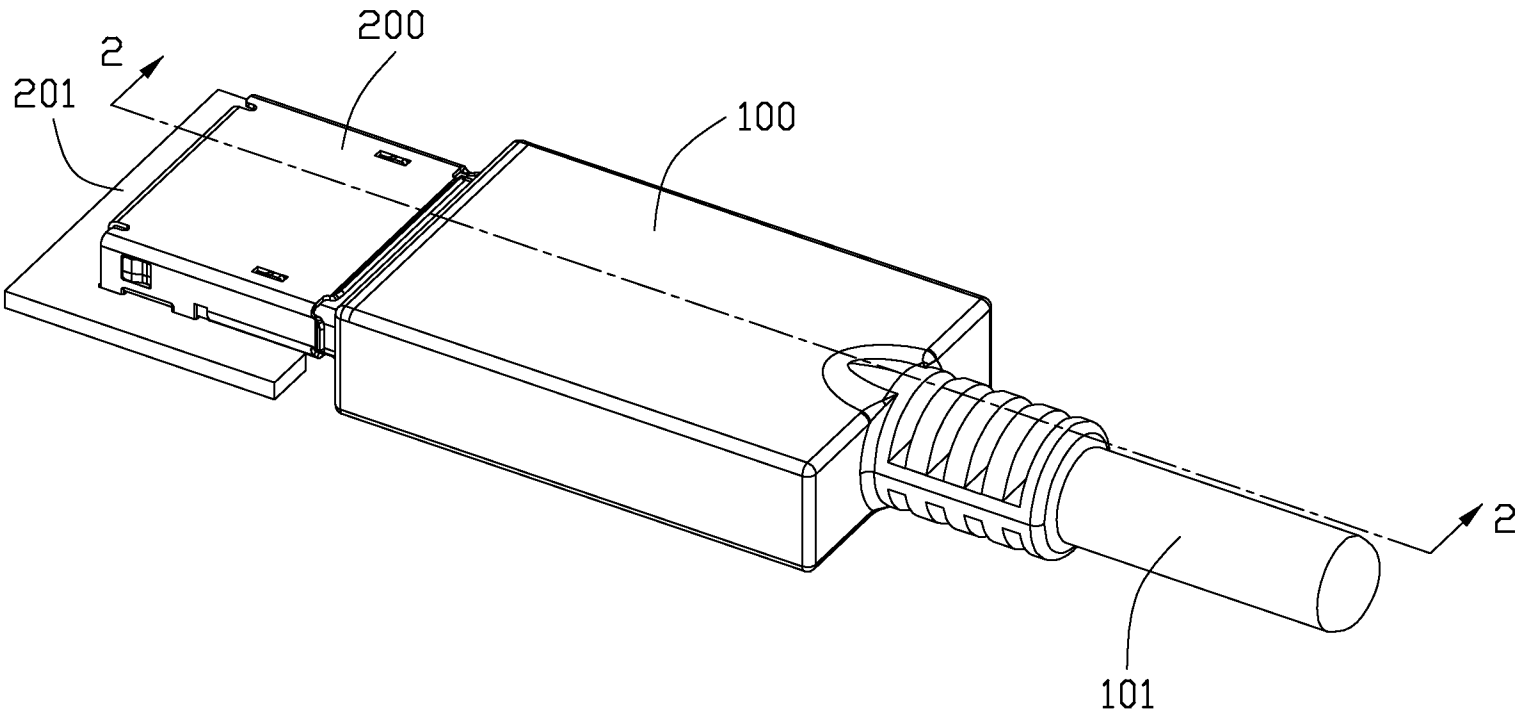
FIG. 1 is an assembled perspective view of a cable connector in accordance with the present invention, which mates with a board connector.

Reference will now be made to the drawing figures to describe the present invention in detail.

Figure 2:
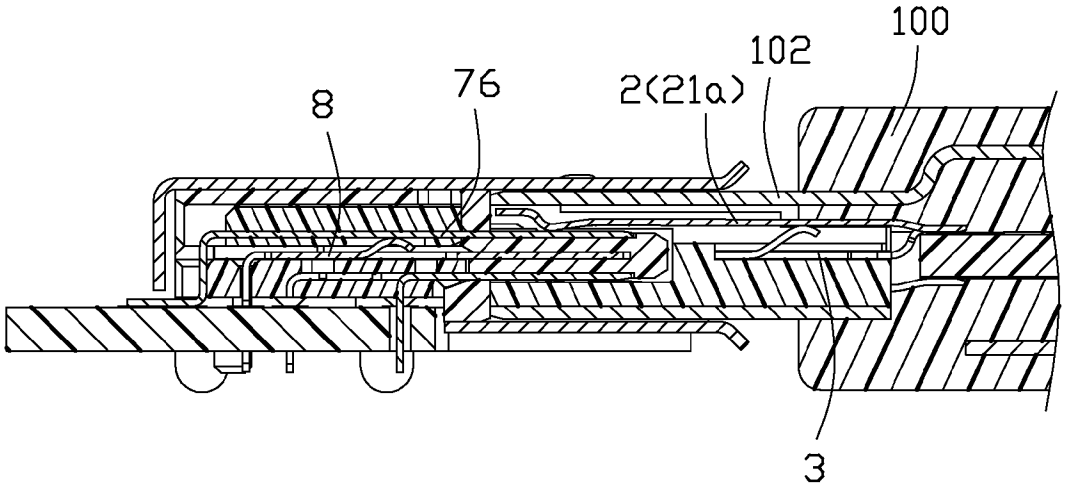
FIG. 2 is a cross-sectional view of FIG. 1 taken along lines 2-2.

Referring to FIGS. 1-2, a cable connector 100 made in accordance with the present invention connecting with a cable 101, is engaging with a board connector 200 mounted on a printed circuit board 201. The cable connector 100 surrounded with a metallic shell 102, comprises a grounding plate 3 touching with grounding terminals 21*a* of conductive terminals 2 located therein. The board connector 200 comprises a grounding plate 8 touching with corresponding grounding terminals 76 of conductive terminals thereof. Said two grounding plates benefit reduction of cross-talk produced between the upper and lower rows of the terminals and reduction of electrical length to modify resonance frequencies.

Figure 3:
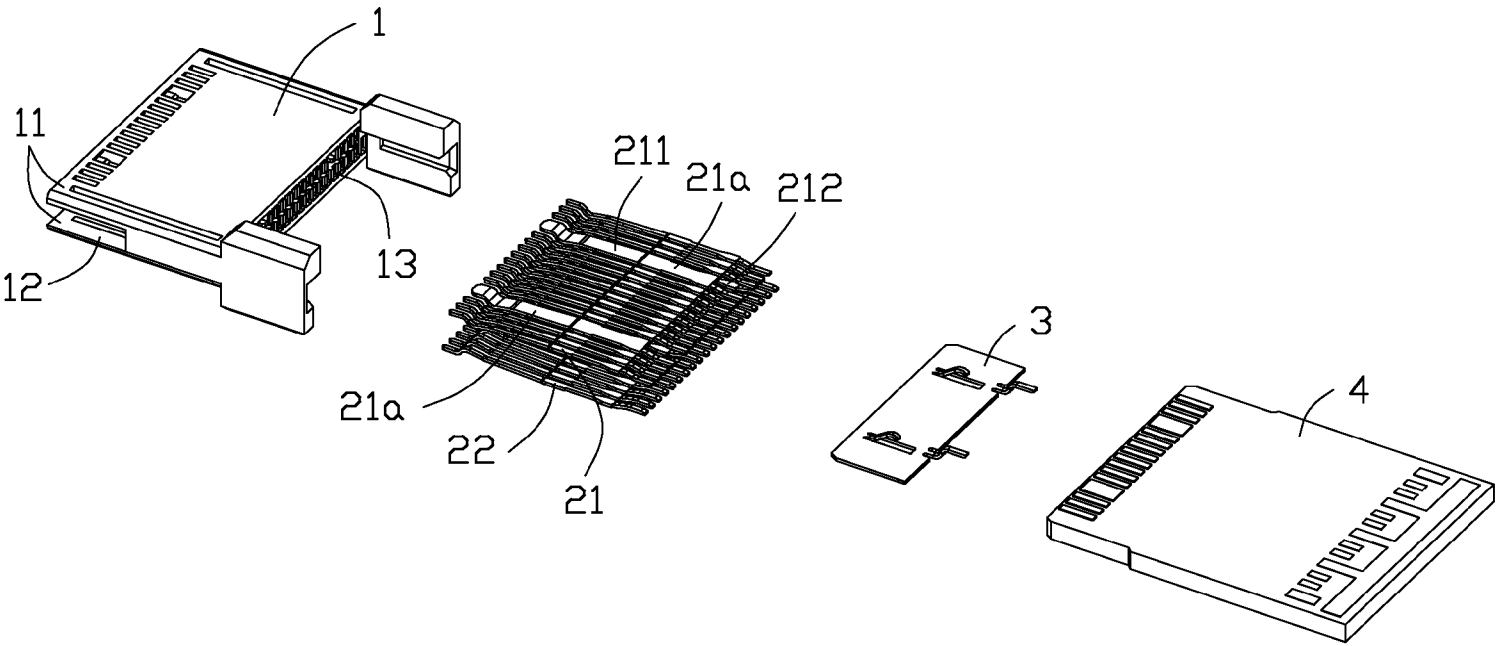
FIG. 3 is an exploded perspective view of the cable connector shown in FIG. 1 without the metallic shell.

Referring to FIG. 3, the cable connector 100 comprises insulating housing 1 defining two front sidewalls 11, resulting in a mating slot 12 between said two front sidewalls 11. A plurality of passageways 13 are disposed along the inner of the sidewalls 11 and run through a rear end of the housing. Two rows of terminals 21, 22 are inserted forwardly into the passageways 13. The first row of terminals 21 has two wider grounding terminals 21*a* in the terminal row, which have a similar configuration to the reminder terminals and are used for power delivery and grounding function. The terminals comprise contacting portions 211 at one ends thereof and connecting portions 212 at another ends thereof. Middle portions have bars for retaining with the passageways 13. After the terminals 2 are received in passageways 13 shown in FIG. 4, the contacting portions 211 are exposed to the mating slot 11 and arc free ends 213 of the contacting portions in the holes 111 defined in front edges of the sidewalls 11. The connecting portions 212 are located behind the rear edge of the housing. Please notes, the connecting portions 212*a* of the wider grounding terminals have a same wide dimension with other terminals. Therefore, a free space 214 is kept behind the grounding terminal, i.e., a larger interval is formed between a terminal and the grounding terminal. A pair of posts 14 are defined at two sides of the rear edge of the housing, an inverted U-shaped guiding recess 141 is defined at each post 14. The two guiding recesses 141 are aligned with a space between the connecting portions 212 of said two rows of terminals 2. Two latch arms 103 are received in grooves defined at two sides of the sidewalls, which can be formed with the metallic shell 102.

Figure 4:
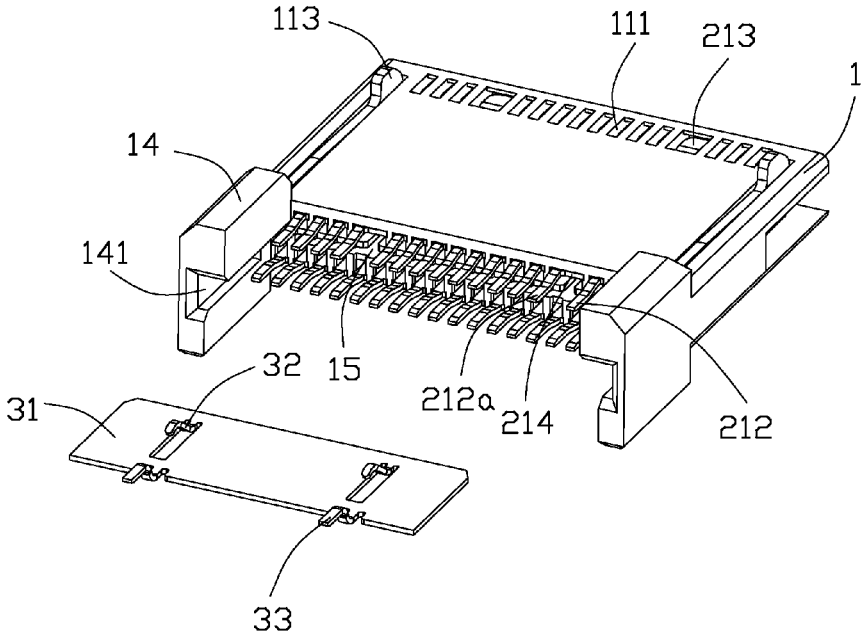
FIG. 4 is a partially assembled perspective view of FIG. 3.
Figure 5:
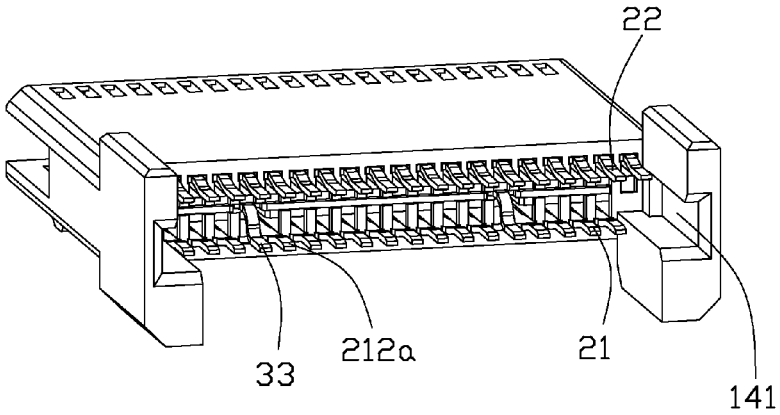
FIG. 5 is a partially assembled perspective view of FIG. 3.

The grounding plate 3 comprises a main body 31, two resilient arms 43 slanting rearwards and two connecting legs 33 bending rearwards. The resilient arms and the connecting legs slant upward towards the first row of the terminals 21. The grounding plate 3 is inserted in a slit 15 running through the rear edge of the housing as best shown in FIG. 4. The grounding plate 3 partitions most of said two rows of terminals. The connecting legs 33 extend in the free space 214 adjacent to the connecting portion 212*a*, so that connecting portions in the first row have regular intervals.

Figure 6:
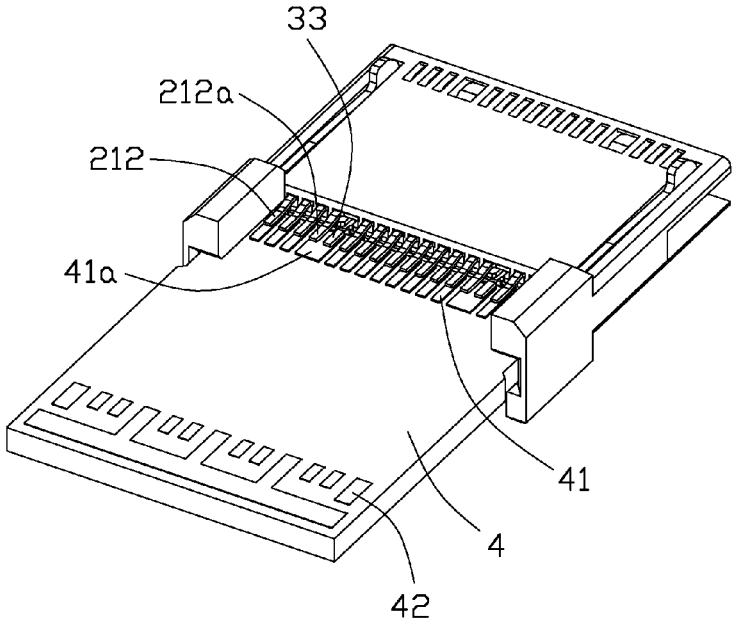
FIG. 6 is an assembled perspective view of FIG. 4.

Referring to FIG. 6, an electronic board 4 is inserted along the guiding recesses 141 of the post so as to connect with the connecting portions 212 of the terminals and the connecting legs 33 of the grounding plate 3. The adjacent connecting portion 212*a* of the grounding terminal and the connecting leg 33 of the grounding plate are seated on a same conductive pad 41 on one end of the board. The other end of the board has conductive pads 42 to connect with conductive wires of the cable 101.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector comprising:

an insulative housing comprising two sidewalls and a mating slot defined between the two sidewalls;

a plurality of terminals received in the insulative housing, the terminals comprising contacting portions exposed to the mating slot and connecting portions behind a rear end of the insulating housing;

the two sidewalls loaded with a first row and a second row of the plurality of terminals respectively, the first row comprising signal terminals and grounding terminals; and a grounding plate inserted in the insulating housing and between said two rows of the plurality of terminals;

wherein the grounding plate defines resilient arms and connecting legs, the resilient arms slant to the first row of the plurality of terminals and touch with the grounding terminals of the first row;

an electronic board comprising first conductive pads at one end thereof to connect with the connecting portions of the terminals and second conductive pads at another end thereof to connect with conductive wires of a cable;

wherein every adjacent connecting leg of the grounding plate and the connecting portion of the grounding terminal connect with one conductive pad of the electronic board, the connecting leg electrically and mechanically connected to said printed circuit board.

2. The cable connector as claimed in claim 1, wherein the grounding terminals are wider than the signal terminals except that the connecting portions of the grounding terminals have a same width to the connecting portions of the signal terminals.

3. The cable connector as claimed in claim 2, wherein the grounding plate defines connecting legs behind the rear end of the insulating housing.

4. The cable connector as claimed in claim 3, wherein the connecting legs of the grounding plate are located adjacent the connecting portions of grounding terminals.

5. The cable connector as claimed in claim 4, wherein the adjacent connecting leg of grounding plate and connecting portion of the grounding terminal are located side by side.

6. A cable connector comprising:

an insulative housing surrounding with a metallic shell and defining with mating slot;

a first row of terminals, the terminal comprising contacting portions exposed to one side of the mating slot and connecting portion exposed to a rear end of the insulating housing;

the terminals of the first row comprising signal terminals and grounding terminals; and a grounding plate disposed in the insulating housing, the grounding plate defining connecting legs and resilient arms touching with the grounding terminals;

wherein the contacting portions of the terminals of the first row have regular intervals, the contacting portions of the grounding terminals are wider than that of the signal terminals and the contacting, the connecting legs of the grounding plate and the connecting portions of the grounding terminals have same widths and regular intervals;

wherein the resilient arms slant rearwards;

wherein the connecting legs and the connecting portions slant oppositely, the connecting legs electrically and mechanically connected to said printed circuit board.

7. A cable connector assembly comprising:

an insulative housing defining a mating cavity for receiving a mating tongue of a complementary receptacle;

two rows of passageways arranged in a transverse direction and each of said passageways extending in the housing along a front-to-back direction perpendicular to said transverse direction; a plate receiving slot formed in the housing between the two rows of the passageways in a vertical direction perpendicular to both said transverse direction and said front-to-back direction, said plate receiving slot being rearwardly open to an exterior in said front-to-back direction;

two rows of resilient contacts forwardly inserted and disposed in the corresponding passageways, respectively, each of said contacts defining a front mating section extending into the mating cavity for coupling to a corresponding terminal of the complementary receptacle, a middle retaining section retained to the housing, and a rear connecting section for electrically connecting to a corresponding wire of a cable; and a grounding plate forwardly inserted into the plate receiving slot from a rear side of the housing; wherein at least one resilient arm unitarily extends rearwardly from the grounding plate to mechanically and electrically connect one grounding terminal of said two rows of resilient contacts around the corresponding retaining section;

further including a printed circuit board is located behind the housing on which the connecting sections of the contacts are mounted for electrical connection, wherein said grounding plate further unitarily forms a connecting leg electrically and mechanically connected to said printed circuit board.

8. The cable connector assembly as claimed in claim 7, wherein the grounding terminal defines a wider retaining section than those of remaining contacts to easily contact the resilient arm, and a wider circuit pad formed on the printed circuit board to which both the connecting leg of the grounding plate and the connecting section of said grounding terminal are mounted, compared with regular ones to which the connecting sections of the remaining contacts are mounted, respectively.

* * * * *